US006367153B1

(12) United States Patent
Aota et al.

(10) Patent No.: US 6,367,153 B1
(45) Date of Patent: Apr. 9, 2002

(54) METHOD OF MANUFACTURING FUEL INJECTION VALVE

(75) Inventors: Masayuki Aota; Norihisa Fukutomi; Kazuo Matsunaga, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/709,515

(22) Filed: Nov. 13, 2000

(30) Foreign Application Priority Data

Nov. 10, 1999 (JP) ..... 11-320206

(51) Int. Cl.[7] ..... B21K 1/20
(52) U.S. Cl. ..... 29/890.124; 29/464
(58) Field of Search ..... 29/890.124, 890.12, 29/464; 251/129.15, 129.01–129.09, 129.1–129.22; 239/533.2, 585.5, 585.4, 472, 473, 477, 478

(56) References Cited

U.S. PATENT DOCUMENTS 4,651,926 A * 3/1987 Sasao et al.
4,740,347 A * 4/1988 Sloan, Jr. et al.
4,971,254 A * 11/1990 Daly et al.
5,207,384 A * 5/1993 Horsting
5,678,767 A * 10/1997 Rahbar
5,954,274 A 9/1999 Sumida et al.

FOREIGN PATENT DOCUMENTS

| | | |
|---|---|---|
| JP | 2-215963 | 8/1990 |
| JP | 7-10471 | 2/1995 |
| JP | 10-47209 | 2/1998 |

* cited by examiner

*Primary Examiner*—Icuda Rosenbaum
*Assistant Examiner*—T. Nguyen

(57) ABSTRACT

In a valve main body, there is provided a guide pin having an aligning end portion for aligning with respect to a central axis of a fuel injection path. This guide pin is inserted into the valve main body, and a whirler is inserted into the guide pin, and a valve seat is fixed at one end of the valve main body such that the aligning end of the guide pin is aligned with respect to the central axis of the fuel injection path. The guide pin is then pulled away from the valve main body, and the valve body is inserted into the valve main body so that the section of the valve body to be slid in the whirler can be inserted into the valve body sliding hole.

4 Claims, 6 Drawing Sheets

METHOD OF MANUFACTURING FUEL INJECTION VALVE

BACKGROUND OF THE INVENTION

The present invention relates a method of manufacturing a fuel injection valve used for supplying fuel to various engines incorporated into an automobile. More particularly, the present invention relates a method of manufacturing a fuel injection valve by which fuel is whirled and supplied to a fuel injection path of a valve seat.

Conventionally, there is provided a fuel injection valve, the valve body of which is cylindrical, in which a valve such as a needle valve or ball valve is arranged and a valve seat having a fuel injection path is arranged at an outlet of the cylindrical valve main body, and fuel supplied from the outside the valve is whirled by a whirler so that fuel, which is supplied from the outside, can be fed to the fuel injection path. FIG. 4 is a cross-sectional view showing an example of the conventional fuel injection device in which the above fuel injection valve is used. FIG. 5 is an enlarged cross-sectional view of the fuel injection valve of the fuel injection device. FIG. 6 is an enlarged cross-sectional view of another fuel injection valve of the fuel injection device.

In FIG. 4, reference numeral 1 is a fuel injection device, reference numeral 2 is a housing body of the fuel injection device 1, and reference numeral 3 is a fuel injection valve which is supported by a lower end portion of the housing body 2 by means of calking. Reference numeral 4 is a fuel supply pipe, reference numeral 5 is a cylinder head of an engine, and reference numeral 6 is a valve operation device having an electromagnetic coil 61 and others for operating a needle valve 12 described later. A forward end portion of the fuel injection device 1 is inserted into a fuel injection device insertion hole 51 formed in a cylinder head 5 of the engine.

In FIG. 5, reference numeral 9 is a valve main body of the fuel injection valve 3, reference numeral 11 is a valve seat, reference numeral 12 is a needle valve, and reference numeral 13 is a whirler. The valve main body 9 is a cylindrical body having an insertion port 91 into which the needle valve 12 is inserted, a small diameter section 92 and a large diameter section 93. The valve seat 11 and the whirler 13 are fixed to the large diameter section 93 of the valve main body 9 which are arranged as shown in the drawing. At the center of the valve seat 11, there is provided a fuel injection path 10. At the center of the whirler 13, there is provided a valve body sliding hole 131. The needle valve 12 includes: an armature 121, a large diameter section 122, and a small diameter section 123 to be slid in the whirler. An outer diameter of the forward end section of the needle valve 12, which continues to the section 123 to be slid in the whirler, is gradually reduced, and the forward end section of the needle valve 12 enters the fuel injection path 10 and closes the entrance opening of the fuel injection path 10. An outer diameter of the large diameter section 122 is a little smaller than the inner diameter of the small diameter section 92 so that the large diameter section 122 can slide on the inner wall face of the small diameter section 92 of the valve main body 9. An outer diameter of the section 123 to be slid in the whirler is a little smaller than the inner diameter of the valve body sliding hole 131 so that the section 123 to be slid in the whirler can penetrate the valve main body sliding hole 131 of the whirler 13 and slide on the inner wall of the valve body sliding hole 131 of the whirler 13. Due to the foregoing, the entire needle valve 12 can go ahead and back in the valve main body 9 by the valve operation device 6 and armature 121 shown in FIG. 4 so as to open and close the fuel injection path 10 of the valve seat 11.

In this connection, in general, the whirler 13 can be inserted inside the large diameter section 93 of the valve main body 9 without being given any press-fitting pressure, however, the outer diameter of the whirler 13 is determined so that no clearance is substantially formed between the outer wall of the whirler 13 and the inner wall of the large diameter section 93 after the whirler 13 has been arranged in the large diameter section 93. On the other hand, the outer diameter of the valve seat 11 is determined so that a press-fitting pressure can be required when the valve seat 11 is inserted inside the large diameter section 93 of the valve main body 9. When the valve seat 11 is press-fitted inside the large diameter section 93, it can be fixed inside the large diameter section 93. At the same time, the valve seat 11 fixes the whirler 13 in the large diameter section 93.

The fuel injection valve 3 shown in FIG. 5 is manufactured in the following manufacturing process. First, the whirler 13 is inserted inside the large diameter section 93 of the valve main body 9 while the fuel introduction port face 132 is being directed to the forward end wall 921 of the small diameter section 92 of the valve main body 9, and then the valve seat 11 is press-fitted inside the large diameter section 93 until the fuel introduction port face 132 of the whirler 13 comes into contact with the forward end wall 921 of the small diameter section 92 of the valve main body 9. Due to the foregoing, the valve seat 11 is fixed inside the large diameter section 93 by the press-fitting pressure created by the valve seat 11 itself, and the whirler 13 is also fixed being interposed between the forward end wall face 921 of the small diameter section 92 and the valve seat 11. Finally, the needle valve 12 is inserted into the valve main body 9 from the insertion hole 91 of the valve main body 9, and the extreme end portion of the needle valve 12 penetrates the valve body sliding hole 131 of the whirler 13 and reaches the entrance opening of the fuel injection path 10.

In this connection, the valve main body 9, needle valve 12, whirler 13 and valve seat 11, which are used when the fuel injection valve 3 is manufactured by the above method, are previously designed so that these parts can have central axis A, which is shown in FIG. 5, in common. However, actually, the centers of these parts do not agree with central axis A because of the fluctuation of dimensional accuracy caused among the manufacturing lots. When the centers of these parts do not agree with central axis A, the following problems may be encountered. Since the whirler 13 and the needle valve 12 interfere with each other, it becomes difficult for the needle valve 12 to be inserted into the whirler. Even if the needle valve 12 can be inserted, the portion 123 of the needle valve 12 to be slid in the whirler 13 partially comes into contact with the inner wall of the whirler 13 in the valve main body sliding hole 131 as shown in FIG. 6 (refer to portion B in FIG. 6). Therefore, the yield and performance of products are affected as described later.

When the portion 123 of the needle valve 12 to be slid in the whirler 13 partially comes into contact with the inner wall of the whirler 13 in the valve body sliding hole 131, an uneven clearance is caused between the outer wall of the section 123 to be slid in the whirler and the inner wall of the valve body sliding hole 131 of the whirler 13. Accordingly, fuel can not be uniformly atomized, and further the extreme end portion of the needle valve 12 can not be appropriately set at the entrance opening of the fuel injection path 10. Therefore, it becomes impossible to appropriately open and close the fuel path 10, and the essential function of the fuel injection valve 3 can not be fully exhibited, or the essential function of the fuel injection valve 3 might be lost. In this connection, in order to prevent the section 123 of the needle valve 12 to be slid in the whirler from coming into partial contact with the valve main body sliding hole 131, the aforementioned clearance may be increased. However, when the clearance is increased, fuel can not be uniformly atomized. Therefore, it is not preferable to increase the clearance. When the dimensional accuracy of each of the aforementioned parts is enhanced, the manufacturing cost of the fuel injection valve 3 is raised, which is not preferable, either.

SUMMARY OF THE INVENTION

In view of the various problems caused by the prior art, it is an object of the present invention to provide a method of manufacturing a fuel injection valve 3 of high performance at a high yield by using parts such as a usual valve main body 9, needle valve 12, whirler 13 and valve seat 11, the dimensional accuracy of which is usual, in other words, by using parts, the dimensional accuracy of which fluctuates among the manufacturing lots in a usual way.

(1) The present invention provides a method of manufacturing a fuel injection valve comprising the steps of: inserting a guide pin into a cylindrical valve main body, the guide pin having an aligning forward end portion for aligning the guide pin with respect to a central axis of a fuel injection path of a valve seat, the guide pin also having an inserting section to be inserted into a whirler, the inserting section of the guide pin to be inserted into a whirler being inserted into a valve body sliding hole of the whirler which supplies fuel to the fuel injection path by whirling fuel, the inserting section of the guide pin to be inserted into the whirler having an outer diameter larger than an outer diameter of a section of the valve body to be slid in the whirler; arranging the whirler at the guide pin by inserting the section of the guide pin to be inserted into the whirler in the valve body sliding hole; fixing the valve seat at one end of the valve main body under the condition that a forward end of the guide pin is aligned with respect to the central axis of the fuel injection path; and pulling out the guide pin from the valve main body and arranging the section of the valve body to be slid in the whirler in the valve body sliding hole.

(2) In item (1), the outer diameter of the inserting section of the guide pin to be inserted into the whirler is larger than the outer diameter of the sliding section of the valve body to be slid in the whirler by at least 10% of the average of the clearance between the whirler and the section of the valve body to be slid in the whirler in the valve body sliding hole.

(3) In item (1) or (2), the outer diameter of the whirler is smaller than the inner diameter of the valve main body in a portion where the whirler is arranged by at least 10 $\mu$m.

(4) In item (1), (2) or (3), the valve seat is fixed to an end of the valve main body by clearance-fitting.

DETAILED DESCRIPTION OF THE PREFERRED EMBODIMENTS (Embodiment 1)

Figure 1:
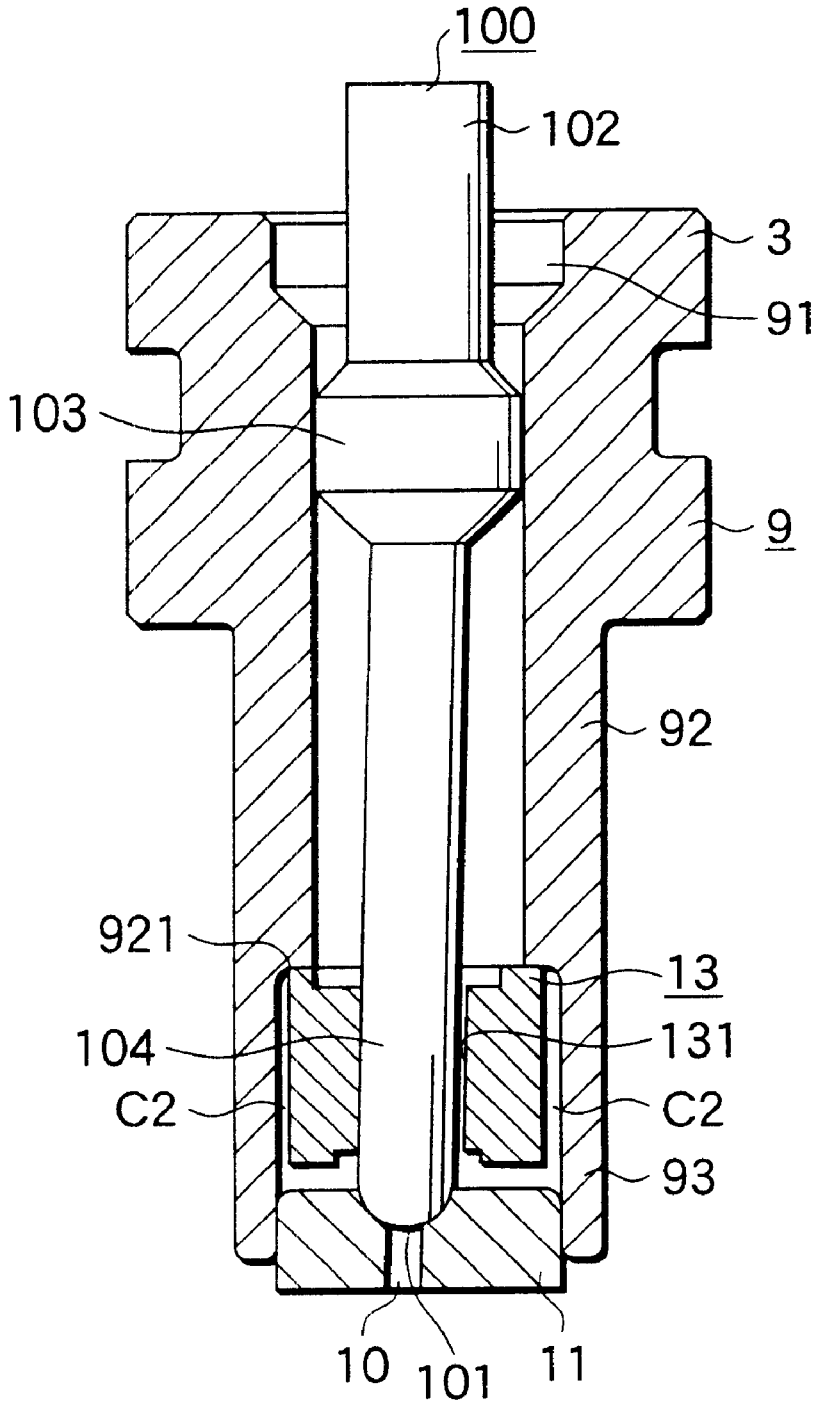
FIG. 1 is a cross-sectional view for explaining Embodiment 1 of the present invention.
Figure 2:
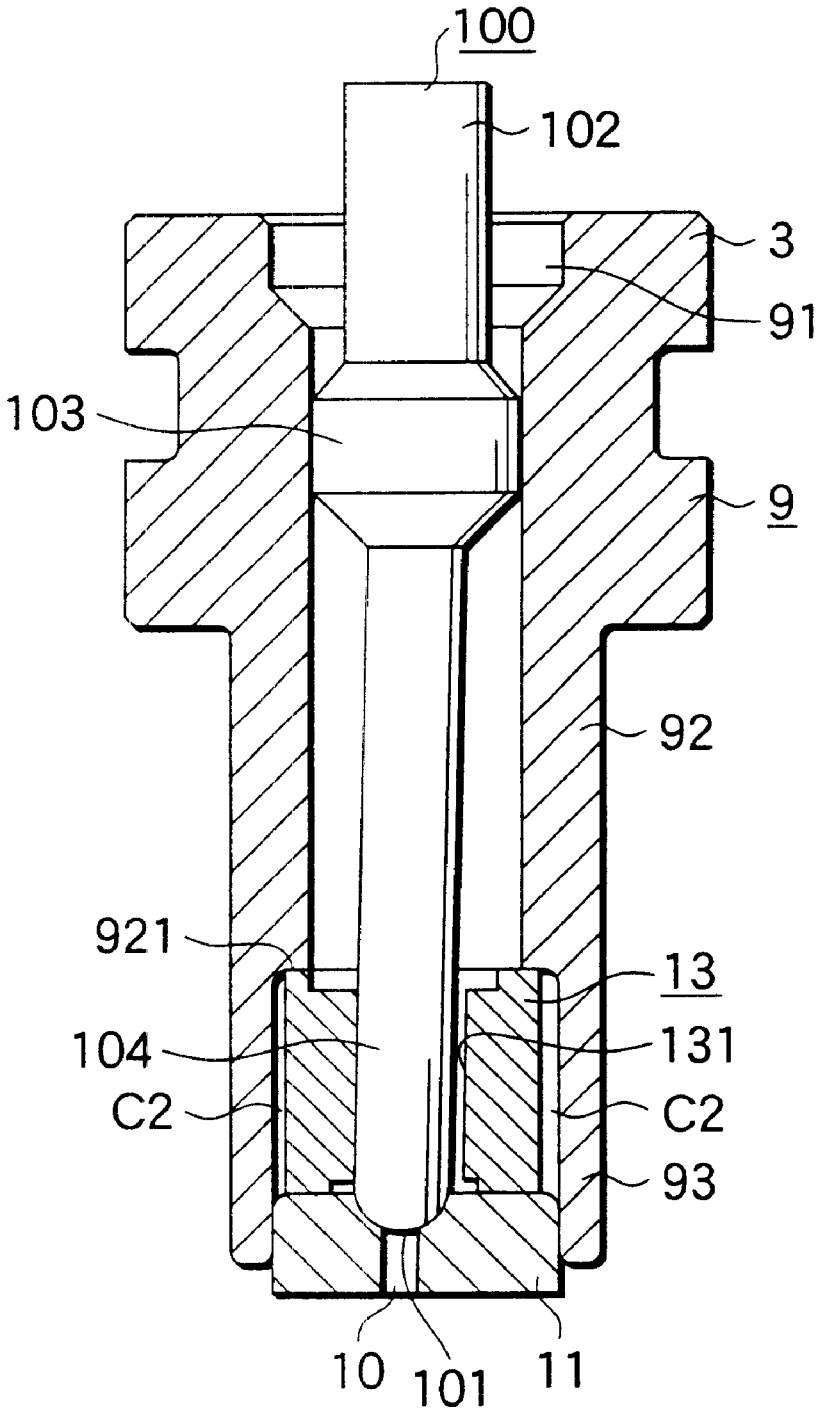
FIG. 2 is a cross-sectional view for explaining Embodiment 1 of the present invention.
Figure 3:
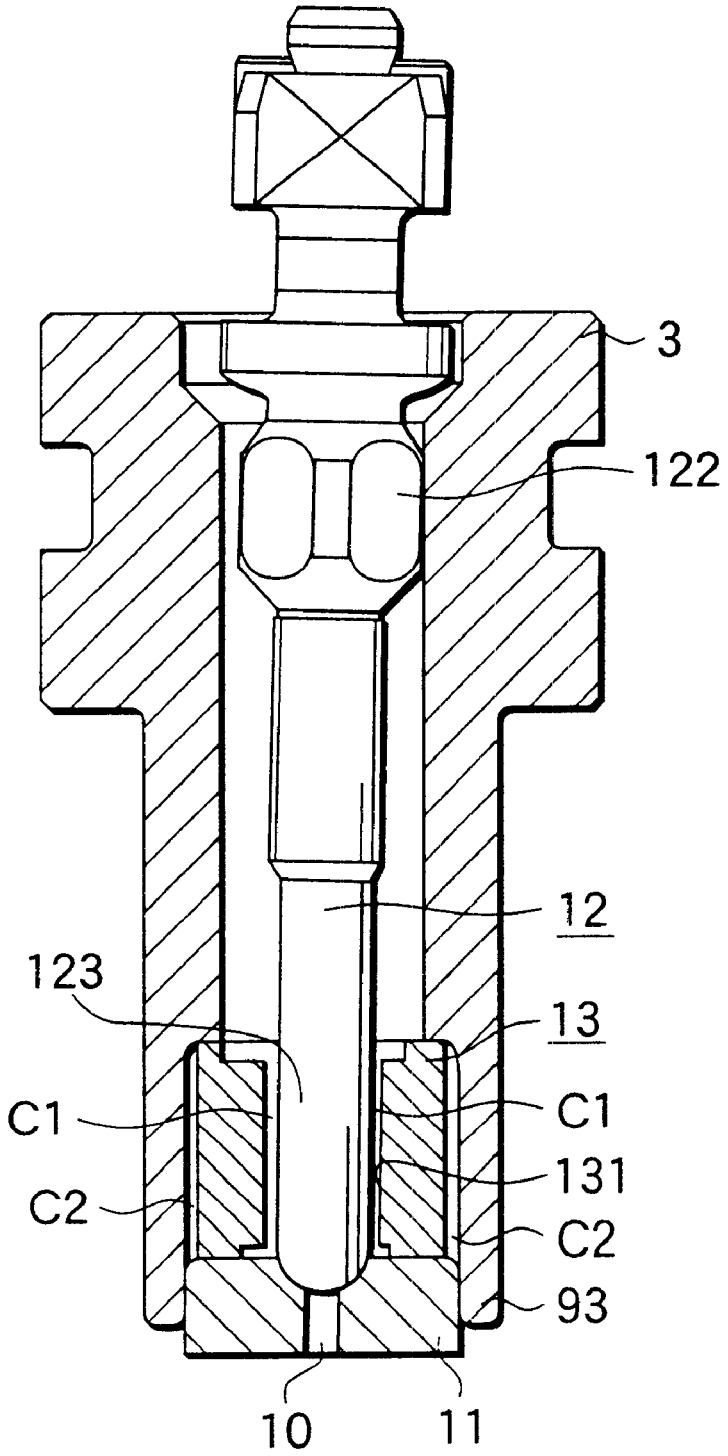
FIG. 3 is a cross-sectional view for explaining Embodiment 1 of the present invention.
Figure 4:
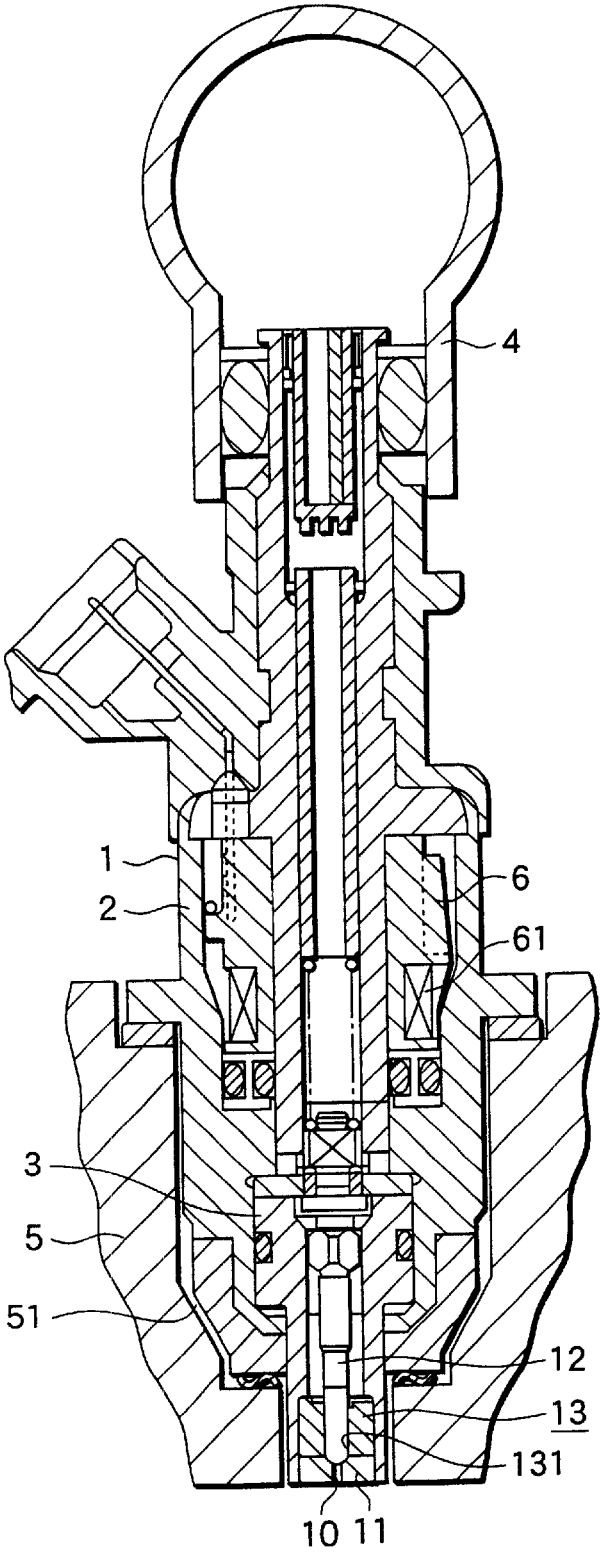
FIG.4 PRIOR ART
FIG. 4 is a cross-sectional view of an example of a conventional fuel injection valve.

FIGS. 1 to 3 are cross-sectional views for explaining Embodiment 1 of the present invention. In FIG. 1, reference numeral 9 is a valve main body having an insertion port 91, small diameter section 92 and large diameter section 93, reference numeral 11 is a valve seat having a fuel injection path, and reference numeral 13 is a whirl having a valve body sliding hole 131. Those parts 9, 11 and 13 are essentially the same as the corresponding parts shown in FIG. 5.

In this connection, reference numeral 100 is a guide pin composed of a head section 102, large diameter section 103, section 104 to be inserted into a whirler and aligning end portion 101 for aligning. The appearance and size of the guide pin 100 are similar to those of the needle valve 12 shown in FIG. 5 described before and FIG. 3 described later. The outer diameter 103 of the large diameter section 103 of the guide pin 100 is substantially the same as that of the large diameter section 122 of the needle valve 12. The outer diameter 103 of the large diameter section 103 is a little smaller than the inner diameter of the small diameter section 92 of the valve main body 9 so that the guide pin 100 can be freely slid in the longitudinal direction on the inner wall of the small diameter section 92 of the valve main body 9. On the other hand, the outer diameter of the section 104 of the guide pin 100 to be inserted into the whirler is a little smaller than the inner diameter of the valve body sliding hole 131 so that the section 104 of the guide pin 100 to be inserted into the whirler can penetrate the valve body sliding hole 131 of the whirler 13. However, the outer diameter of the section 104 of the guide pin 100 to be inserted into the whirler is larger than the outer diameter of the section 123 to be slid in the whirler of the needle valve 12 described later.

First, the guide pin 100 is inserted into the valve main body 9 so that the aligning end portion 101 for aligning can reach a portion close to the opening end of the large diameter section 93 of the valve main body 9. Then, the section 104 of the guide pin 100 to be inserted into the whirler is inserted into the valve body sliding hole 131 of the whirler 13. In this way, the whirler 13 is set at the guide pin 100. Further, under the condition that the aligning end portion 101 for aligning of the guide pin 100 is aligned to the central axis of the fuel injection path 10 of the valve seat 11, the valve seat 11 is inserted into the large diameter section 93 of the valve main body 9. FIG. 1 shows a state in which an approximate half of the valve seat 11 is inserted into the large diameter section 93 of the valve main body 9. Successively, the remaining half of the valve seat 11 is also press-fitted into the large diameter section 93 of the valve main body 9. FIG. 2 shows a state in which the entire valve seat 11 is inserted into the large diameter section 93 of the valve main body 9. In the above state, the whirler 13 is interposed and fixed between the forward end wall 921 of the small diameter section 92 of the valve main body 9 and the valve seat 11. Finally, the guide pin 100 is pulled out from the valve main body 9. Instead of the guide pin 100, the needle valve 12 is inserted into the valve main body 9 so that the forward end portion of the needle valve 12 can close the entrance opening of the fuel injection path 10 of the valve seat 11. In this way, the fuel injection valve 3 shown in FIG. 3 can be manufactured.

Figure 6:
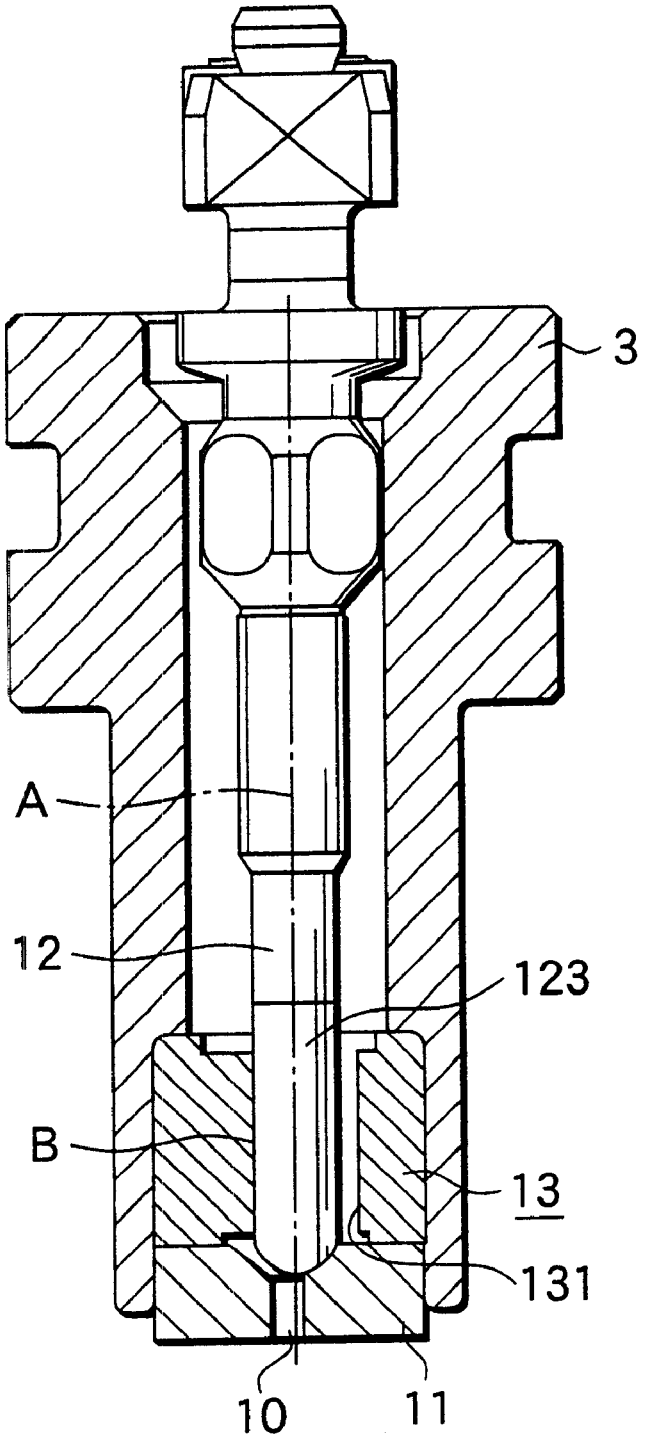
FIG.6 PRIOR ART
FIG. 6 is another enlarged cross-sectional view of the valve device 3 shown in FIG. 4.

In general, it is preferable that the needle valve 12 is highly coaxially arranged with respect to the central axis of the valve main body 9 in the fuel injection valve 3. However, in the case of the fuel injection valve 3 manufactured by the conventional manufacturing method, when the needle valve 12 is not coaxially arranged with respect to the central axis of the valve main body 9 in the fuel injection valve 3, problems may be caused in the opening and closing performance of the entrance opening of the fuel injection path 10 as described referring to FIG. 6. On the other hand, in the case of the fuel injection valve 3 manufactured by the present invention, even when the needle valve 12 is not somewhat coaxially arranged in the fuel injection valve 3, the opening and closing performance of the entrance opening is excellent. The reason will be explained as follows.

In FIG. 3, in order to facilitate the understanding, there is shown an exaggerating state in which the needle valve 12 is arranged eccentrically with respect to the central axis of the valve main body 9 (Refer to the right and the left clearance Cl, Cl between the outer wall of the needle valve 12 and the inner wall of the whirler 13 in the valve main body sliding hole 131 of the whirler 13.) Even if the needle valve 12 is a little eccentrically arranged, the forward end of the needle valve 12 is inserted instead of the guide pin 100 which has been set so that the entrance opening of the fuel injection path 10 can be closed. Therefore, the entrance opening can be positively opened and closed by the forward end.

Even if the portion 104 of the guide pin 100 to be inserted into the whirler partially comes into contact with the inner wall of the whirler 13 in the valve main body sliding hole 131 in the state shown in FIG. 2 (state before the guide pin 100 is pulled out from the valve main body 9), in the case where the needle valve 12 is inserted instead of the guide pin 100, that is, in the state shown in FIG. 3, the outer diameter of the portion 123 of the needle valve 12 to be slid in the whirler is smaller than the outer diameter of the portion 104 of the guide pin 100 to be inserted into the whirler. Therefore, a clearance is caused between the portion 123 of the needle valve 12 to be slid in the whirler and the inner wall of the whirler 13. Therefore, the partial contact described above can be avoided, and fuel can be uniformly injected from the fuel injection path 10 of the valve seat 11.

In this description, A is defined as an average of clearance C1 between the whirler 13 and the portion 123 of the needle valve 12 to be slid in the whirler in the valve main body sliding hole 131. In general, A is approximately 10 $\mu$m. When clearance is smaller than 0.1 A at the narrowest portion of clearance C1, a problem is caused in which a uniform quantity of fuel can not be injected. Therefore, in the present invention, in order to ensure the clearance, the outer diameter of the portion 104 to be inserted into the whirler and the outer diameter of the portion 123 to be slid in the whirler are compared with each other. As a result of the comparison, it is preferable that the outer diameter of the portion 104 to be inserted into the whirler is larger than the outer diameter of the portion 123 to be slid in the whirler by at least 10% of the above value A.

In Embodiment 1, the guide pin 100 is used, the cross-sectional shape of the aligning forward end portion 101 of which is the same as the cross-sectional shape of the forward end portion of the needle valve 12, that is, when it comes to the forward end portion, the outer diameter is gradually reduced. However, it should be noted that the shape of the guide pin is not limited to the above specific embodiment. As long as the guide pin can be aligned with respect to the central axis of the fuel injection path 10 of the valve seat 11, any shape of the guide pin can be adopted.

Figure 5:
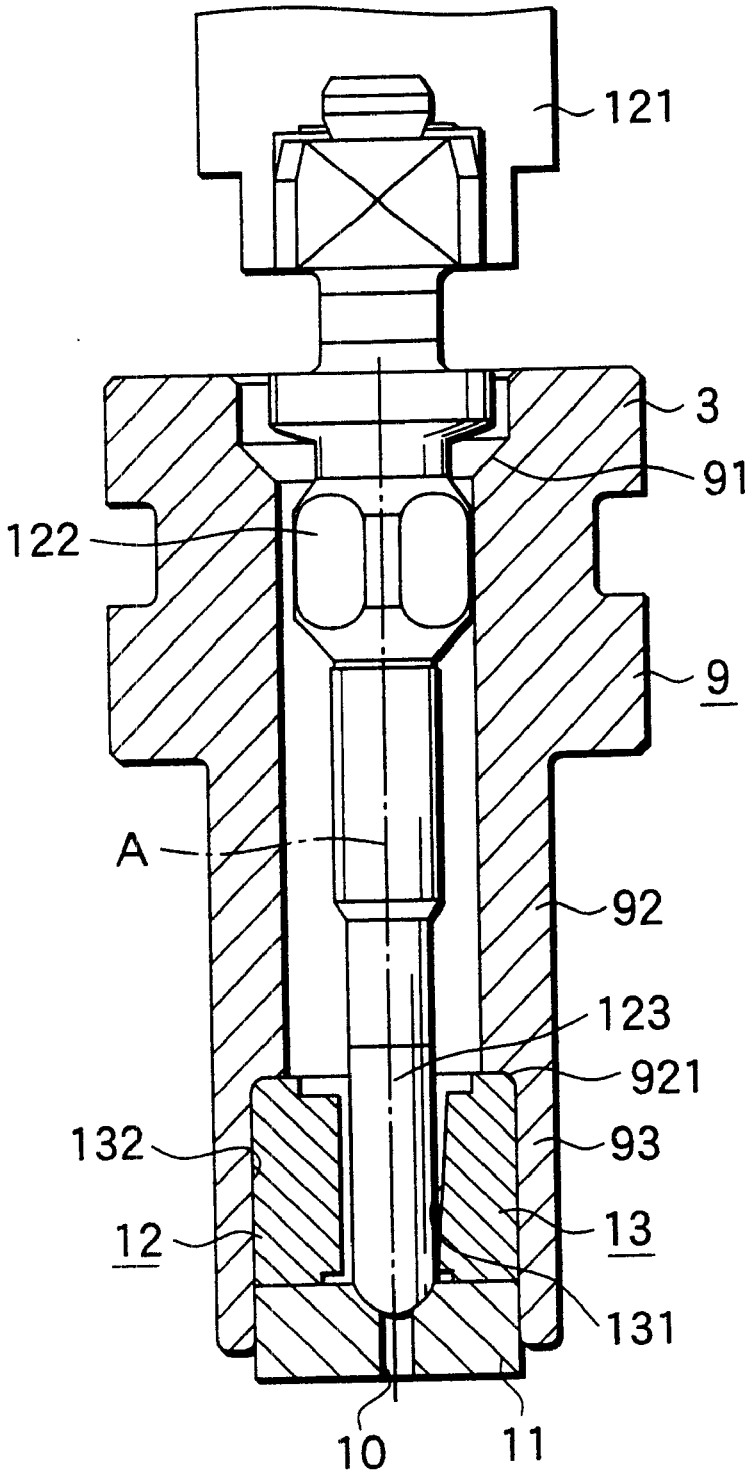
FIG.5 PRIOR ART
FIG. 5 is an enlarged cross-sectional view of the valve device 3 shown in FIG. 4.

In Embodiment 1, the outer diameter of the whirler 13 is smaller than the inner diameter of the large diameter section 93 of the valve main body 9. Therefore, clearance C2 exists between the outer wall of the whirler 13 and the inner wall of the large diameter section 93. In the present invention, it is possible to use the whirler 13 by which clearance C2 can not be substantially created as shown in FIG. 5, that is, it is possible to use the whirler 13, the outer diameter of which is approximately close to the inner diameter of the large diameter section 93. However, when clearance C2 exists, the following remarkable effects can be provided. When clearance C2 exists, even if the outer diameter of the whirler 13 and the inner diameter of the large diameter section 93 of the valve main body 9 fluctuate a little, clearance C2 absorbs the fluctuation, so that the object of the present invention can be easily accomplished. Further, when clearance C2 exists, it is allowed that the dimensions of the whirler 13 and the valve main body 9 fluctuate a little. Therefore, these parts can be easily manufactured, and the manufacturing cost of the fuel injection valve 3 of the present invention can be reduced. In this case, it is preferable that the outer diameter of the whirler 13 is sufficiently smaller than the inner diameter of the large diameter section 93 of the valve main body 9, for example, by at least 10 $\mu$m. Especially, it is preferable that the outer diameter of the whirler 13 is smaller than the inner diameter of the large diameter section 93 of the valve main body 9 by a value at least twice as high as the value A described before.

(Embodiment 2)

In the same manner as Embodiment 1, after the whirler 13 has been inserted into the guide pin 100 from the aligning forward end 101 side, the valve main body 9, guide pin 100, valve body sliding hole 131 of the whirler 13 are aligned so that the axes of those parts can substantially agree with the axis of the valve main body 9. Then, the valve seat 11, which has previously been cooled and thermally shrunk, is used, and while the aligning forward end 101 of the guide pin 100 is set at a position so that it can come to a substantial center of the fuel injection path 10 of the valve seat 11, the valve seat 11 is inserted into the large diameter section 93 of the valve main body 9 and fixed at the end of the large diameter section 93 of the valve main body 9 by means of clearance-fitting. Finally, the guide pin 100 is pulled out from the valve main body 9, and the needle valve 12 is inserted into the valve main body 9 so that the forward end of the needle valve 12 can close the fuel injection path 10 of the valve seat 11.

Embodiment 2 is different from Embodiment 1 at the following points. In Embodiment 2, the axes of the valve main body 9, the guide pin 100 and the valve body sliding hole 131 of the whirler 13 are aligned so that they can agree with the axis of the valve main body 9. Also, in Embodiment 2, the valve seat 11 is fixed in the large diameter section 93 of the valve main body 9 by means of clearance-fitting. In this case, the aligning of each axis may be conducted by an arbitrary method. When the aligning is conducted, the needle valve 12, which is inserted into the valve main body 9 instead of the guide pin 100, can be more smoothly moved in the valve main body 9, and the clearance between the needle valve 12 and the whirler 13 can be made uniform, and fuel can be atomized more uniformly.

On the other hand, when the valve seat 11 is press-fitted into the valve main body in the manner described in Embodiment 1, burr is created. The thus created burr might cause problems, which can not be anticipated, for example, the thus created burr gets into the fuel injection path 10 and closes it. When the means of clearance-fitting is adopted, the above problems are not caused, and further the valve seat 11 can be highly strongly fixed in the valve main body 9.

As explained above, the present invention provides a method of manufacturing a fuel injection valve comprising the steps of: inserting a guide pin into a cylindrical valve main body, the guide pin having an aligning forward end portion for aligning the guide pin with respect to a central axis of a fuel injection path of a valve seat, the guide pin also having an inserting section to be inserted into a whirler, the inserting section of the guide pin to be inserted into a whirler being inserted into a valve body sliding hole of the whirler which supplies fuel to the fuel injection path by whirling fuel, the inserting section of the guide pin to be inserted into the whirler having an outer diameter larger than an outer diameter of a section of the valve body to be slid in the whirler; arranging the whirler at the guide pin by inserting the section of the guide pin to be inserted into the whirler in the valve body sliding hole; fixing the valve seat at one end of the valve main body under the condition that a forward end of the guide pin is aligned with respect to the central axis of the fuel injection path; and pulling out the guide pin from the valve main body and arranging the section of the valve body to be slid in the whirler in the valve body sliding hole. Accordingly, the valve main body, valve body, whirler and valve seat are of usual dimensional accuracy, in other words, even if the dimensions of those parts somewhat fluctuate, the problem of partial contact of the valve body with the valve sliding hole, which occurs in the fuel injection valve manufactured by the conventional method, can be solved. As a result, fuel can be atomized uniformly. Further, since the extreme forward end portion of the valve is excellently set at the entrance of the fuel injection path, the fuel injection path can be smoothly opened and closed. Therefore, according to the present invention, it is possible to manufacture a fuel injection valve of high performance at low cost by using usual inexpensive parts.

The outer diameter of the inserting section of the guide pin to be inserted into the whirler is larger than the outer diameter of the sliding section of the valve main body to be slid in the whirler by at least 10% of the average of the clearance between the whirler and the section of the valve main body to be slid in the whirler in the valve main body sliding hole. Due to the foregoing, the problem of partial contact of the valve body with the valve sliding hole can be more positively solved.

When the outer diameter of the whirler is smaller than the inner diameter of the valve main body in a portion where the whirler is arranged by at least 10 $\mu$m, especially when the outer diameter of the whirler is smaller than the inner diameter of the valve main body in a portion where the whirler is arranged by a value at least twice as high as the value A, a clearance is created between the outer wall of the whirler and the inner wall of the large diameter section. Therefore, even if the outer diameter of the whirler and the inner diameter of the large diameter section of the valve main body somewhat fluctuate, the fluctuation can be absorbed by the clearance. Therefore, a remarkable action can be performed to accomplish the object of the present invention. When the above clearance exists, some fluctuation can be allowed in the dimensions of the whirler and the valve main body. Accordingly, it becomes unnecessary to apply a high level of quality control to the manufacture of these parts. As a result, the manufacturing cost of the fuel injection valve of the present invention can be reduced.

When the valve seat is fixed to an end of the valve main body by clearance-fitting, there is no possibility of the creation of burr which tends to be created in the process of fixing the valve seat to the valve main body by means of press-fitting, and further the valve seat can be highly strongly fixed in the valve main body.

What is claimed is:

1. A method of manufacturing a fuel injection valve comprising the steps of:

inserting a guide pin into a cylindrical valve main body, said guide pin having an aligning forward end portion for aligning said guide pin with respect to a central axis of a fuel injection path of a valve seat, said guide pin also having an inserting section to be inserted into a whirler, said inserting section of said guide pin to be inserted into a whirler being inserted into a valve body sliding hole of said whirler which supplies fuel to said fuel injection path by whirling fuel, said inserting section of said guide pin to be inserted into said whirler having an outer diameter larger than an outer diameter of a section of said valve body to be slid in said whirler;

arranging said whirler at said guide pin by inserting said section of said guide pin to be inserted into said whirler in the valve body sliding hole;

fixing said valve seat at one end of said valve main body under the condition that a forward end of said guide pin is aligned with respect to the central axis of said fuel injection path; and pulling out said guide pin from said valve main body and arranging said section of said valve body to be slid in said whirler in said valve body sliding hole.

2. The method of manufacturing a fuel injection valve according to claim 1, wherein an outer diameter of said inserting section of said guide pin to be inserted into said whirler is larger than an outer diameter of said sliding section of said valve body to be slid in said whirler by at least 10% of the average of the clearance between said whirler and said section of said valve body to be slid in said whirler in the valve body sliding hole.

3. The method of manufacturing a fuel injection valve according to claim 1, wherein an outer diameter of said whirler is smaller than an inner diameter of said valve main body in a portion where said whirler is arranged by at least 10 $\mu$m.

4. The method of manufacturing a fuel injection valve according to claim 1, wherein said valve seat is fixed to an end of said valve main body by clearance-fitting.

* * * * *